US007184565B2

(12) United States Patent
Ohta

(10) Patent No.: US 7,184,565 B2
(45) Date of Patent: Feb. 27, 2007

(54) HEADPHONE

(75) Inventor: Takashi Ohta, Tokyo (JP)

(73) Assignee: Sony Corporation, Tokyo (JP)

( * ) Notice: Subject to any disclaimer, the term of this patent is extended or adjusted under 35 U.S.C. 154(b) by 119 days.

(21) Appl. No.: 10/528,696

(22) PCT Filed: Aug. 11, 2004

(86) PCT No.: PCT/JP2004/011808

§ 371 (c)(1),
(2), (4) Date: Mar. 22, 2005

(87) PCT Pub. No.: WO2005/018276

PCT Pub. Date: Feb. 24, 2005

(65) Prior Publication Data

US 2006/0013429 A1 Jan. 19, 2006

(30) Foreign Application Priority Data

Aug. 13, 2003 (JP) ..... 2003-293078

(51) Int. Cl.
*H04R 25/00* (2006.01)

(52) U.S. Cl. ..... 381/384; 381/381

(58) Field of Classification Search ..... 381/378, 381/379, 394, 395, 376, 384, 370, 374, 383, 381/386, 375; 242/378.4, 385.4, 410, 146; 379/433.04, 430, 438, 431, 433.01, 433.02, 379/433.03, 433.05, 433.11, 433.12, 433.13; 455/90, 90.3, 575.2, 349, 350; D14/205, D14/223; D21/420

See application file for complete search history.

(56) References Cited

U.S. PATENT DOCUMENTS

| | | | | |
|---|---|---|---|---|
| 6,480,611 | B2 * | 11/2002 | Hashimoto et al. | 381/371 |
| 6,937,725 | B2 * | 8/2005 | Liao | 379/438 |
| 2003/0169896 | A1 * | 9/2003 | Kirk et al. | 381/370 |

FOREIGN PATENT DOCUMENTS

| | | |
|---|---|---|
| JP | 143778/1982 | 9/1982 |
| JP | 2000-253477 | 9/2000 |
| JP | 2002-10385 | 1/2002 |

* cited by examiner

*Primary Examiner*—Sinh Tran
*Assistant Examiner*—Lloyd Weekes
(74) *Attorney, Agent, or Firm*—Oblon, Spivak, McClelland, Maier & Neustadt, P.C.

(57) ABSTRACT

In order to provide headphones with a cord-winding mechanism capable of favorably retracting and winding a cord, a cord-winding mechanism is incorporated in either or both of the casings of housings 1L and 1R constituting headphones; and a lock is released by joining the left and right casings together, so that the cord is retracted and wound.

4 Claims, 7 Drawing Sheets

HEADPHONE

TECHNICAL FIELD

The present invention relates to headphones provided with a mechanism which retracts and winds a cord into housings.

BACKGROUND ART

In recent years, headphones have come to be frequently used outdoors as well, following the development of portable acoustic equipment. Moreover, with the progress of the age of individualization especially amongst youngsters, demand for design-focused products is being heightened also with respect to headphones, and headphones of an ear-hook type without a headband have been widely used, and also used outdoors more and more frequently.

When a pair of ear-hook type headphones is carried and stored, since a thin rod-like ear-hook arm is installed in a casing, and the left and right casings are independently provided, a cord easily becomes entangled with the casings, which is greatly inconvenient. In order to deal with such a cord, there has conventionally been a structure that solves the trouble caused by a cord, in which a cord is retracted and wound around a reel in a headphone body by means of the resilience of a spring. On the other hand, in the case of headphones provided with a mechanism which retracts and winds a plug-attached cord, if a lock of retracting and winding is released with the headphones being worn on a user's auricles, it is possible that a plug at the end could hit his/her auricle or face when pulled in with great force, which is unfavorable.

As a means to solve the above problem, a mechanism in which by putting a plug into a casing, a lock that prevents a cord from being retracted and wound into the casing is released so as to retract and wind the cord has been proposed. FIG. 12 is a figure showing an example of headphones provided with a conventional cord-winding mechanism. A hanger 91 to be worn on an auricle is attached to a housing 90 storing a loudspeaker unit inside. Further, a cord 92, in which a plug 93 is attached to the end thereof, is retracted and wound by a winding mechanism 94 inside the housing 90. The retracting and winding by the winding mechanism 94 uses the resilience of a spring incorporated, and are normally locked. Hereupon, a plug insertion portion 95 into which the plug 93 at the end of the cord 92 is inserted is provided in the housing 90, and when the plug 93 is inserted into the plug insertion portion 95 as shown in FIG. 12, an end 93*a* of the plug 93 unlocks the winding mechanism 94 as shown by the arrow R to retract and wind the cord 92.

In Japanese Published Patent Application No. 2002-10385 issued by Japan Patent Office, examples of a headphone provided with a conventional cord-winding mechanism are disclosed.

However, in the structure shown in FIG. 12, when the retracting and winding have finished, a bushing portion 93*b* of the plug 93 becomes bent due to the nature of the structure, and it remains bent to be shown unattractively until the next time when used, and excessive force is applied to the cord. In addition, bending the cord in this manner leads to durability problems such as the breaking of a signal line inside the cord.

The purpose of the present invention is to provide headphones with a cord-winding mechanism that is capable of retracting and winding a cord favorably.

DISCLOSURE OF INVENTION

The first aspect of the present invention is headphones including: first and second housings each incorporating a loudspeaker unit and each having ribs capable of being joined to each other; a plug-attached cord, one end of which is connected to the inside of the first housing, and the other end of which has a plug; inside the first housing, a plug-attached cord winding means which retracts and winds the cord by means of the resilience of a spring; a locking means which controls the retracting and winding by the plug-attached cord winding means; and a release means which releases the control of the retracting and winding of a plug-attached cord by the locking means, when the first and second housings are joined together by the ribs.

With the above construction, since the cord is retracted and wound by joining the casings of the left and right housings that form the headphones, this makes it possible to retract and wind the cord favorably without applying unnecessary force thereto. Further, since the locking is released by combining the left and right casings provided independently into one body, the cord can not be retracted and wound with the headphones being worn on a user's auricles, and the plug at the end of the cord can therefore be prevented from hitting an auricle or the face when being pulled in with great force. Furthermore, since the left and right casings are combined into one body, capability to be stored and portability thereof can be improved.

The second aspect of the present invention is the headphones according to the first aspect of the present invention, further including: a connecting cord that connects first and second housings; inside the first or second housing a connecting cord winding means which retracts and winds the connecting cord by means of the resilience of a spring; a locking means which controls the retracting and winding by the connecting cord winding means; and a release means which releases the control of the retracting and winding of the connecting cord by the locking means, when the first and second housings are joined together by the ribs.

With the above construction, the connecting cord which connects the first and second housings can be favorably retracted and wound as well by joining the casings of the left and right housings.

The third aspect of the present invention is the headphones according to the second aspect of the present invention, in which the first and second housings each have a hanger to be worn on the auricles.

With the above construction, a connecting cord of the headphones, each of which has the hanger to be worn on the auricle, can favorably be retracted and wound.

The fourth aspect of the present invention is the headphones according to the first aspect of the present invention, in which a headband connecting the first and second housings is provided, and the first and second housings connected by the headband can be combined by ribs.

With the above construction, a plug-attached cord of the headphones which have the headband can favorably be retracted and wound.

BEST MODE FOR CARRYING OUT THE INVENTION

Hereinafter, an embodiment of the present invention will be explained referring to FIGS. 1 to 5.

Figure 1:
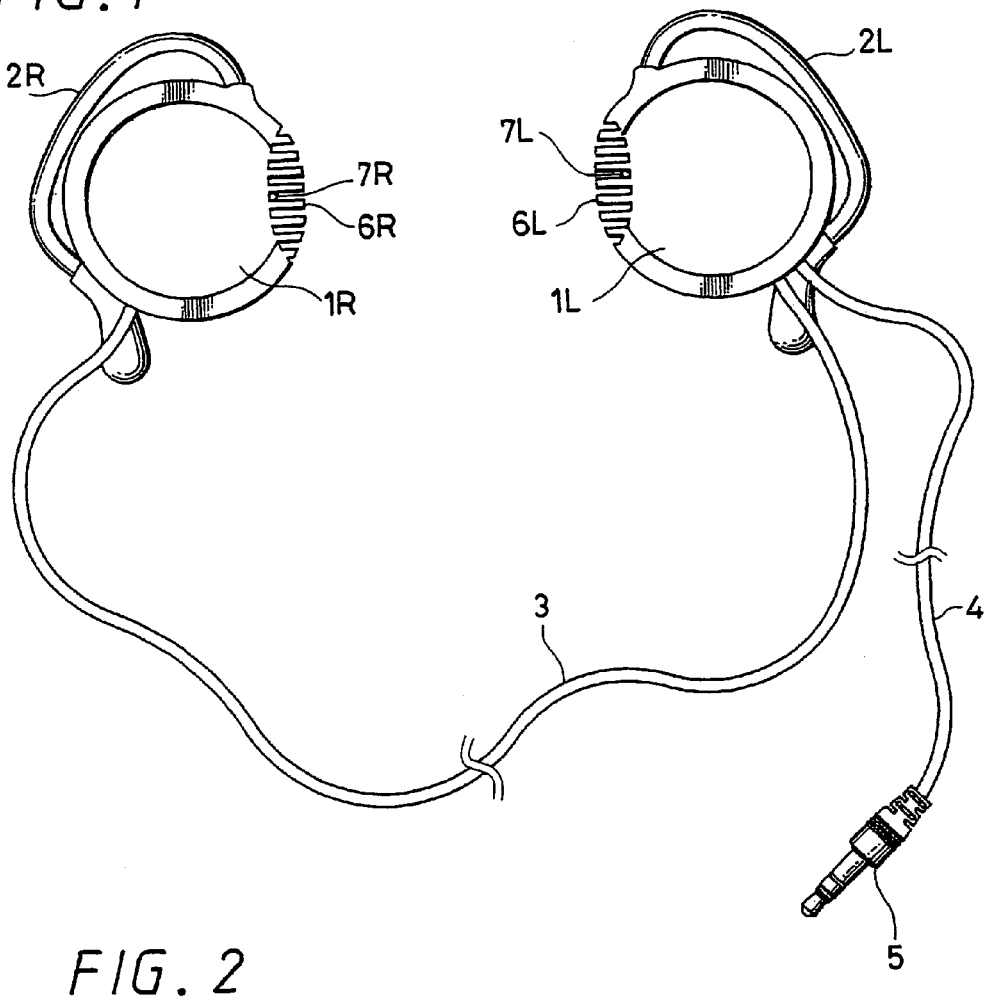
FIG. 1 is an external view showing headphones according to an embodiment of the present invention.
Figure 2:
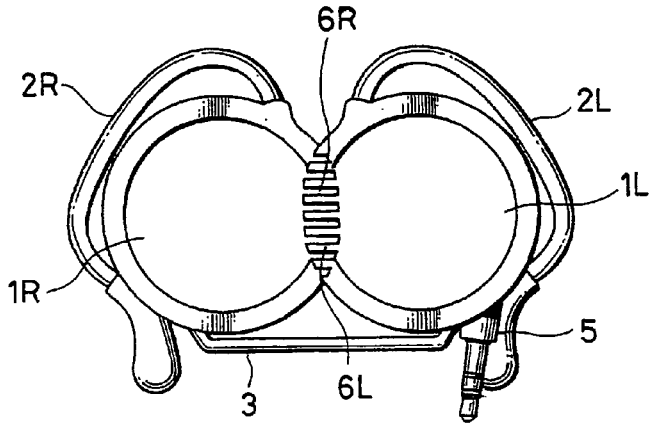
FIG. 2 is an external view showing an example of the state in which housings of the headphones according to an embodiment of the present invention have been joined together.

FIG. 1 is an external view of headphones of the present invention, and FIG. 2 is an external view of the state in which housings 1L and 1R forming the headphones of this embodiment have been joined together. The headphones of this embodiment are formed of the pair of left and right housings 1L and 1R which are formed of resin, and a loudspeaker unit (not shown in the figures) which outputs sound is incorporated in the housings 1L and 1R, respectively. The loudspeaker units are made to output sounds corresponding to audio signals provided from external acoustic equipment via cords 3 and 4 described later on. Hangers 2L and 2R to be worn on the ears are attached to the housings 1L and 1R, respectively and the left and right housings 1L and 1R are connected to each other by a connecting cord 3. A plug-attached cord 4 to which a plug 5 connected to acoustic equipment is attached is connected to one housing, in this embodiment to the left housing 1L, and so audio signals are input. The connecting cord 3 supplies audio signals which have been input, from the left housing 1L to the loudspeaker unit inside the right housing 1R. On the edge of the surfaces of the housings 1L and 1R are formed fixing ribs 6L and 6R for joining the left and right housings together. In this embodiment, the fixing ribs 6L and 6R are shaped like a comb, and the ribs 6L and 6R are formed at positions on the edges close to the front (face) of the head when the housings 1L and 1R are worn on the auricles. The ribs 6L of the left housing 1L and the ribs 6R of the right housing 1R can be engaged with each other to be joined as shown in FIG. 2.

Figure 5:
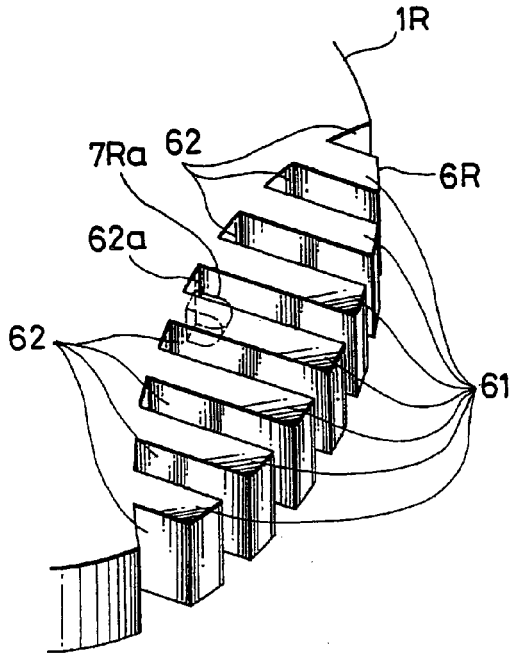
FIG. 5 is an enlarged perspective view of a fixing rib portion according to an embodiment of the present invention.

Further, release levers 7L and 7R for holding and releasing the state in which the cords have been retracted and wound are provided at parts of the fixing ribs 6L and 6R, respectively. FIG. 5 is an enlarged perspective view of the rib 6R portion of the right housing 1R. The ribs 6R are shaped like a comb and composed of convex portions 61 and concave portions 62. Although not shown in the figure, the ribs 6L of the left housing 1L are composed of concave portions which fit into the convex portions 61 of the right ribs 6R, and convex portions which fit into the concave portions 62 thereof. The release lever 7R, whose mechanism is arranged inside the casing of the housing 1R, includes a protruding portion 7Ra at the end thereof which protrudes into a concave portion 62*a* of the fixing rib. The protruding portion 7Ra of the release lever 7R is constructed to be pushed into the housing 1R by a convex portion of the ribs 6L, when fitting into the rib 6L of the left housing 1L.

FIG. 2 shows the state in which the left and right fixing ribs 6L and 6R have been joined together. A protruding portion 7La of the release lever 7L of the left housing 1L is pushed into the housing 1L to release the locking by a convex portion of the right ribs 6R, and similarly, the protruding portion 7Ra of the release lever 7R of the right housing 1R is pushed into the housing 1R to release the locking by a convex portion of the left ribs 6L. On releasing the locking, the connecting cord 3 and the plug-attached cord 4 are retracted and wound into the casings of the housings; in this embodiment, the connecting cord 3 is retracted and wound into the right housing 1R, and the plug-attached cord 4 is retracted and wound into the left housing 1L. As shown in FIG. 2, in the state in which the plug-attached cord 4 has been fully retracted and wound, the cord is stored with only a part of the plug 5 sticking out of the housing 1L.

Figure 3:
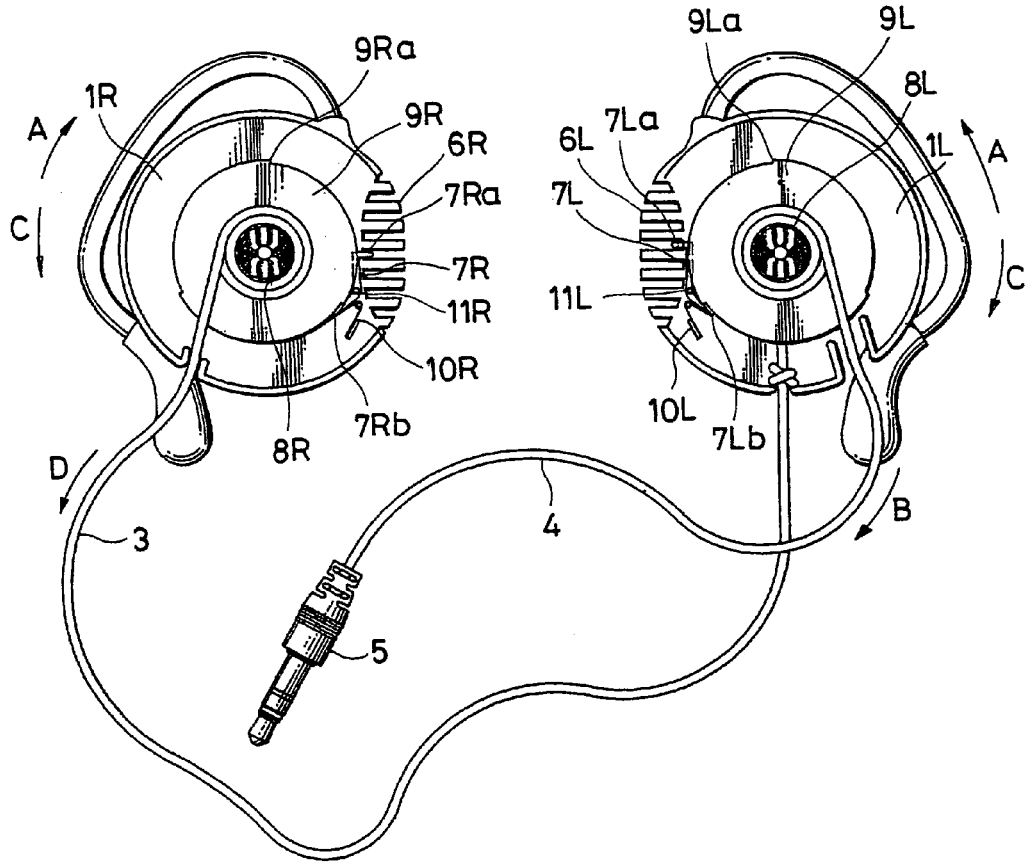
FIG. 3 is a plan view showing an example of the internal structure of the headphones according to an embodiment of the present invention.
Figure 4:
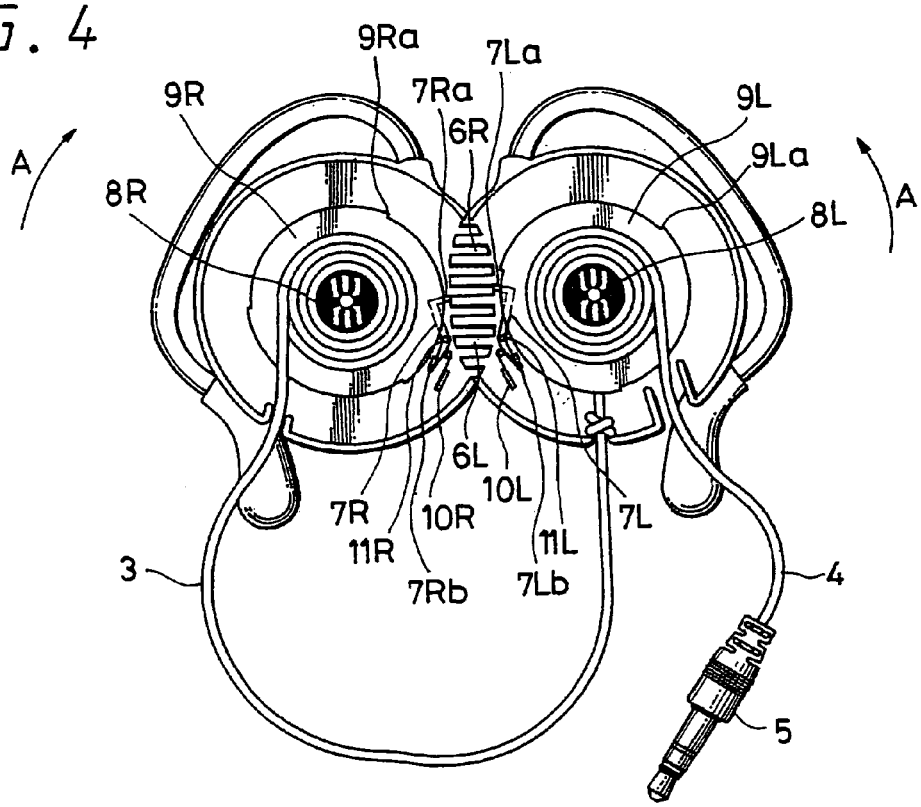
FIG. 4 is a plan view showing an example of the internal structure when housings of headphones according to an embodiment of the present invention have been joined together.

Next, the internal structure of the headphones of this embodiment is explained, referring to FIGS. 3 and 4. FIG. 3 is a plan view showing a winding structure inside the headphones, and FIG. 4 is a plan view showing the winding structure inside the headphones when the cords are being retracted and wound. In addition to the loudspeaker units not shown in the figures, spiral springs 8L and 8R for retracting and winding the cords are fixed inside the left and right housings 1L and 1R, and reels 9L and 9R are rotatably attached. Further, the release levers 7L and 7R for holding and releasing the state in which the cords have been retracted and wound are disposed at positions in contact with the outer peripheries of the reels 9L and 9R, and are attached in a freely rotatable manner to shafts 11L and 11R fixed. The protruding portion 7La at an end of the release lever 7L and the protruding portion 7Ra at an end of the release lever 7R are constructed to protrude into concave portions of the fixing ribs 6L and 6R respectively, and locked portions 7Lb and 7Rb at each of the other ends are constructed to be in contact with the reels 9L and 9R, respectively. Coil springs 10L and 10R to push the release levers 7L and 7R toward the reels 9L and 9R are provided at positions in contact with the locked portions 7Lb and 7Rb of the release levers 7L and 7R outside the reels 9L and 9R.

Operation of retracting and winding the cords in the structure explained above is explained. FIG. 3 shows the state locked in which the spiral springs 8L and 8R are prevented by the locking mechanism from retracting and winding the cords. A plurality of saw-toothed uneven portions 9La and 9Ra are provided on the outer peripheries of the reels 9L and 9R, respectively, and the periphery is evenly divided by each of the uneven portions. In this embodiment, the outer periphery is divided into three and three uneven portions are provided. In the state in which the headphones are separated into the left and right ones, the locked portions 7Lb and 7Rb of the release levers 7L and 7R are caught to be locked by the coil springs 10L and 10R in the uneven portions 9La and 9Ra having dents of the reels. With the locked portions 7Lb and 7Rb dropped into the uneven portions 9La and 9Ra of the reels, the reels 9L and 9R are prevented from rotating in the direction of arrows A shown in FIG. 3 by means of the resilience of the spiral springs 8L and 8R, and so the cords stop being retracted and wound, thereby maintaining the state of the cords.

When the cords of the headphones are stored, the fixing ribs 6L and 6R of the left and right housings 1L and 1R are joined together as shown in FIG. 4. By doing so, the protruding portions 7La and 7Ra of the release levers, which protrude into concave portions of the fixing ribs 6L and 6R, are pushed inward by convex portions of the fixing ribs on the side opposite to each other, allowing the release levers 7L and 7R to rotate around the shafts 11L and 11R, whereby the locked portions 7Lb and 7Rb are separated from the uneven portions 9La and 9Ra of the reels to release the locking. When the locking has been released, the reels 9L and 9R rotate in the direction of the arrows A shown in FIG. 4 by means of the resilience of the spiral springs 8L and 8R, and the reel 9L on the left-hand side retracts and winds the plug-attached cord 4, while the reel 9R on the right-hand side retracts and winds the cord 3.

Next, the case in which the cords of the headphones are pulled out is explained, referring to FIG. 3. When pulling the plug-attached cord 4 out of the housing 1L, first the left and right housings 1L and 1R are separated from each other. By separating the left and right housings 1L and 1R from each other, the protruding portions 7La and 7Ra of release levers, which are pushed inward by convex portions of the fixing ribs 6L and 6R are unlocked, allowing the coil springs 10L and 10R to push the locked portions 7Lb and 7Rb of the release levers toward the reels 9L and 9R; hence, the release levers 7L and 7R rotate around the shafts 11L and 11R, and so the protruding portions 7La and 7Ra of the release levers protrude into concave portions of the fixing ribs 6L and 6R. As a result, the state locked as mentioned earlier is obtained. Then, when pulling the plug-attached cord 4 out of the left housing 1L in the direction of the arrow B shown in FIG. 3, the reel 9L rotates in the direction of the arrow C. On this occasion, pressed against the outer periphery of the reel 9L by the coil spring 10L, the locked portion 7Lb of the release lever 7L rotates along the outer periphery of the reel 9L, dropping into the uneven portion 9La. When the cord has been pulled out for a necessary length and the operation is stopped, the reel 9L rotates in the direction of the arrow A shown in FIG. 3 by means of the resilience of the spiral spring 8L; however, since the locked portion 7Lb drops into the uneven portion 9La of the reel 9L, rotation is stopped to be engaged. Similarly, when the connecting cord 3 is pulled out of the housing 1R, the left and right housings 1L and 1R are separated from each other, and then the cord is pulled out of the right housing 1R in the direction of D shown in FIG. 3. Therefore, a similar operation to the above is performed inside the housing 1R, and so the locking is made possible after the cord has been pulled out with a suitable length.

As described above, the plug-attached cord 4 and the connecting cord 3 are independently retracted and wound in the left and right housings, so that both the cords can be retracted and wound simultaneously and also the length of each cord can be adjusted freely. Further, since the release levers 7L and 7R are installed with protruding portions 7La and 7Ra protruding into concave portions of the fixing ribs 6L and 6R, the locking can only be released when the housings 1L and 1R are combined into one and so the fixing ribs 6L and 6R are fitted together. Therefore, it is impossible to retract and wind the cords when a user is wearing the headphones on his/her auricles.

It should be noted that although a structure in which a plug-attached cord and a connecting cord are independently retracted and wound into left and right housings has been explained, a structure in which both the cords are retracted and wound into either a left or right housing is also possible.

Figure 6:
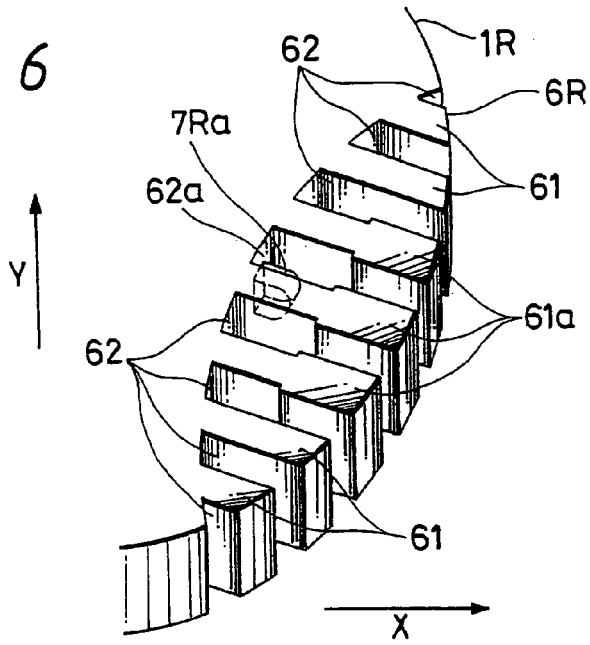
FIG. 6 is an enlarged perspective view of a fixing rib portion according to another embodiment of the present invention.

Further, fixing ribs to join the casings of housings together can be obtained in other shapes. FIG. 6 is an enlarged perspective view showing a rib 6R portion of a right housing 1R. The ribs 6R are shaped like a comb and composed of convex portions 61 and concave portions 62. In this embodiment, each of middle part convex portions 61*a* of the convex portions includes a plurality of steps. Although not shown in the figure, each of ribs of the left housing 1L has similar steps on the convex portion, where the stepped convex portion 61*a* of the right rib 6R comes in contact at the time of fitting. Further, a protruding portion 7Ra at an end of a release lever 7R protrudes into a concave portion 62*a* of the rib. When retracting and winding cords, the fixing ribs 6L and 6R of left and right housings are fitted together; in this embodiment, if the rib portions are made of an elastic material, the left and right housings are fitted into each other in the direction of the arrow X shown in FIG. 6, however if the rib portions are made of a material having less elasticity, the left and right housings are fitted into each other vertically in the direction of the arrow Y shown in FIG. 6. By fitting the left and right housings together, the protruding portions 7La and 7Ra of the release levers 7L and 7R are pushed into the housings 1L and 1R to release the locking. In this embodiment, since steps are provided at the fixing rib portions, the engaged portion makes it possible for the left and right housings to remain joined together and therefore not to detach from each other easily.

Figure 7:
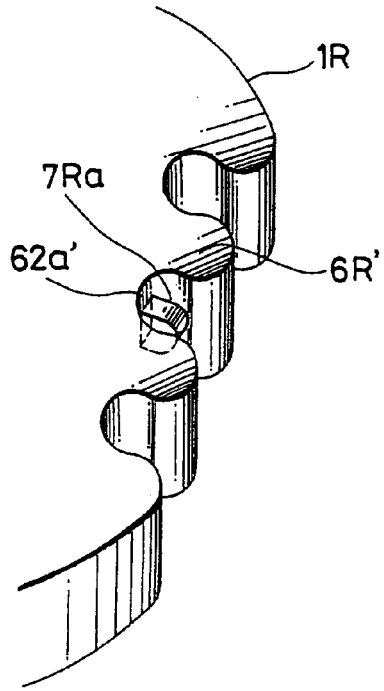
FIG. 7 is an enlarged perspective view of a fixing rib portion according to yet another embodiment of the present invention.

Further, FIG. 7 is an enlarged perspective view showing a fixing rib 6R' portion of a right housing 1R, in the case in which fixing ribs are shaped like waves. Similarly to the other embodiments, a protruding portion 7Ra at an end of a release lever 7R protrudes into a concave portion 62*a*' of the wave-shaped rib 6R'. A rib of a left housing 1L not shown in the figure is shaped like a wave to fit into the right rib 6R', and by fitting the left and right ribs together, the protruding portions 7La and 7Ra of the release levers 7L and 7R are pushed into the housings 1L and 1R to release the locking. In this embodiment, since the wave-shaped uneven portions is constructed to fit into each other, the housings can remain joined together; in addition, by making the rib portions wavy, the impact caused when a rib part hits a hand, the face, etc. can be alleviated.

With the above described shapes, the fixing ribs can be prevented from easily detaching from each other, and the left and right housings can be put together in a stable condition even when being carried. Further, in the above embodiments explanations are made to the fixing ribs formed at positions which come closer to the front (face) of the head when the housings are being worn on the auricles and in which the housings are horizontally joined together; however, it is also possible to employ a construction in which the surfaces of the left and right housings are joined to each other by installing the fixing ribs on the surfaces that are opposite to the surfaces where the housings touch the auricles. Furthermore, any material can be used for the rib portions as long as capable of joining the left and right housings together in a stable condition. As described above, the shape, positions and material of the fixing ribs are not particularly limited to the above embodiments.

Figure 8:
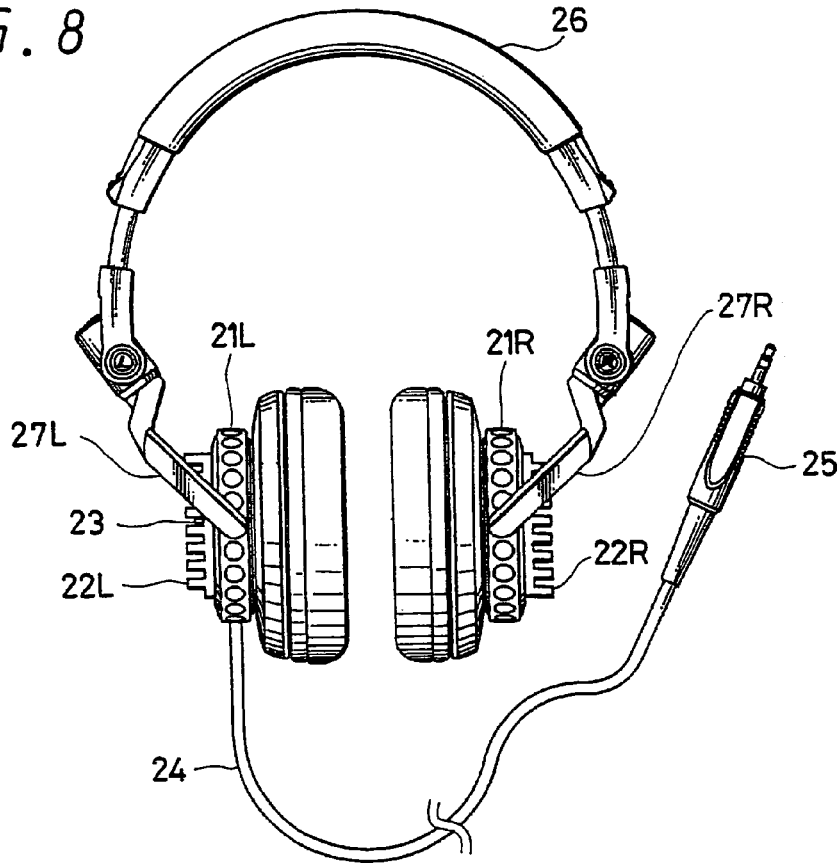
FIG. 8 is an external view showing an example of headphones having a headband according to another embodiment of the present invention.
Figure 9:
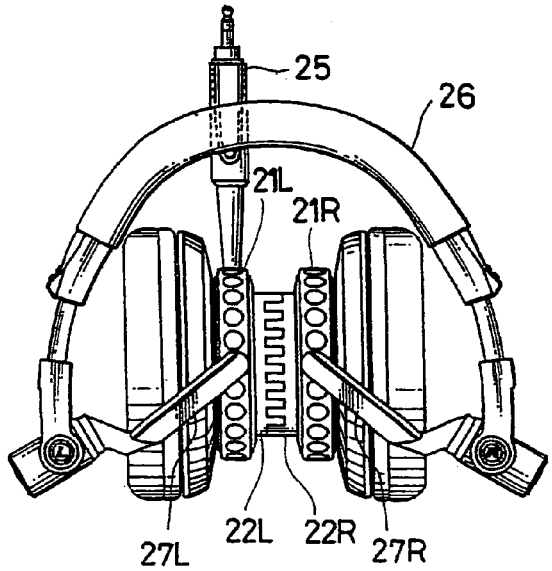
FIG. 9 is an external view showing an example of a state in which housings of the headphones having a headband according to another embodiment of the present invention have been joined together.

Moreover, although explanations are made in the above embodiments with respect to ear-hook type headphones, the cord winding means of those embodiments can also be obtained easily in headphones with a headband, by applying a similar mechanism. FIG. 8 is an external view showing an example in which the cord-winding means according to the embodiment of the present invention is applied to headphones with a headband, and FIG. 9 is an external view showing an example in which the headphones have been joined together. In FIG. 8, each of left and right housings 21L and 21R incorporates a loudspeaker unit (not shown in the figure) which outputs sound, and the left and right housings 21L and 21R are connected by a headband 26 and joining members 27L and 27R. Further, the housings 21L and 21R are constructed to turn by 180° by means of the joining members 27L and 27R. Each of the loudspeaker units incorporated in the housings 21L and 21R respectively outputs sound corresponding to audio signals supplied from external acoustic equipment through a plug-attached cord 24, to which a plug 25 connected to acoustic equipment is attached. The plug-attached cord 24 is connected to one housing, in this embodiment to the left housing 21L, and supplies audio signals to the loudspeaker unit inside the housing 21L. Supplied audio signals are then supplied to the loudspeaker unit inside the right housing 21R through a cord (not shown in the figure) which connects the left and right housings, passing through the headband 26. In the left and right housings 21L and 21R, fixing ribs 22L and 22R are provided on the surfaces opposite to the surfaces in contact with the auricles to which sound from the loudspeaker units inside is output. A release lever 23 is disposed in a concave portion of the fixing rib 22L on the side where the plug-attached cord 24 is connected. Inside the housing 21L, a cord winding mechanism and a locking mechanism which are similar to those explained in FIGS. 3 and 4 as described above are provided, and by pushing a protruding portion of the release lever 23 into the housing 21L, the locking is released to retract and wind the cord.

FIG. 9 shows the state in which the left and right headphones have been joined together, and the cord has been retracted and wound. When retracting and winding the cord, the housings 21L and 21R are turned over by 180° by means of the joining members 27L and 27R, and so the left and right fixing ribs 22L and 22R facing each other are joined together. Joining the fixing ribs 22L and 22R together pushes the release lever 23 into the housing 21L to release the locking, and so the plug-attached cord 24 is retracted and wound into the housing 21L. By doing so, a cord can be retracted and wound by joining left and right housings together with respect to headphones having a headband. Thus, a cord cannot be retracted and wound when a user is wearing headphones, and since left and right housings are joined together, a shape which is suitable to be stored and carried can be obtained.

Figure 10:
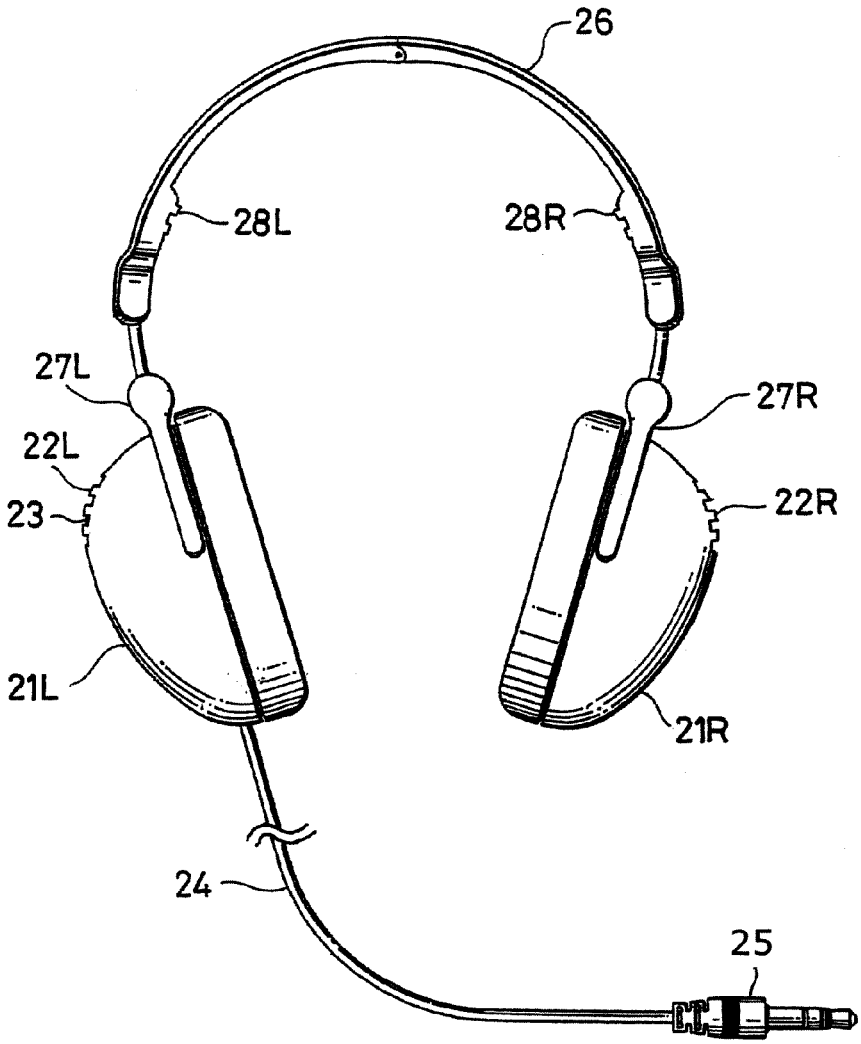
FIG. 10 is an external view showing an example of headphones having a headband according to yet another embodiment of the present invention.
Figure 11:
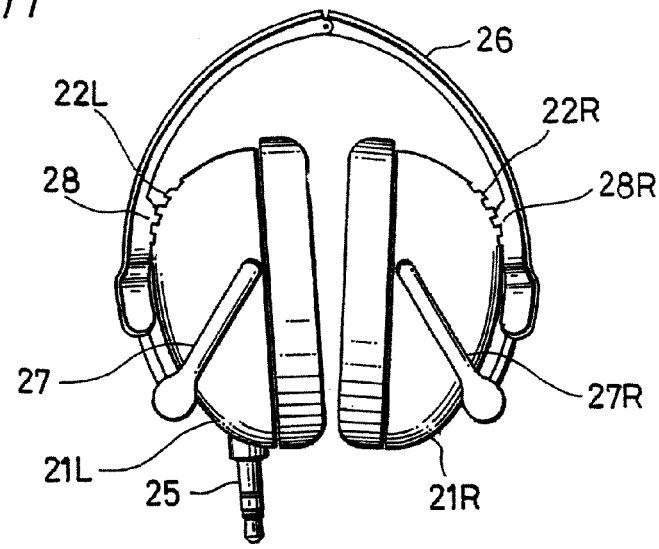
FIG. 11 is an external view showing an example of the state in which housings of the headphones having a headband according to yet another embodiment of the present invention have been folded.
Figure 12:
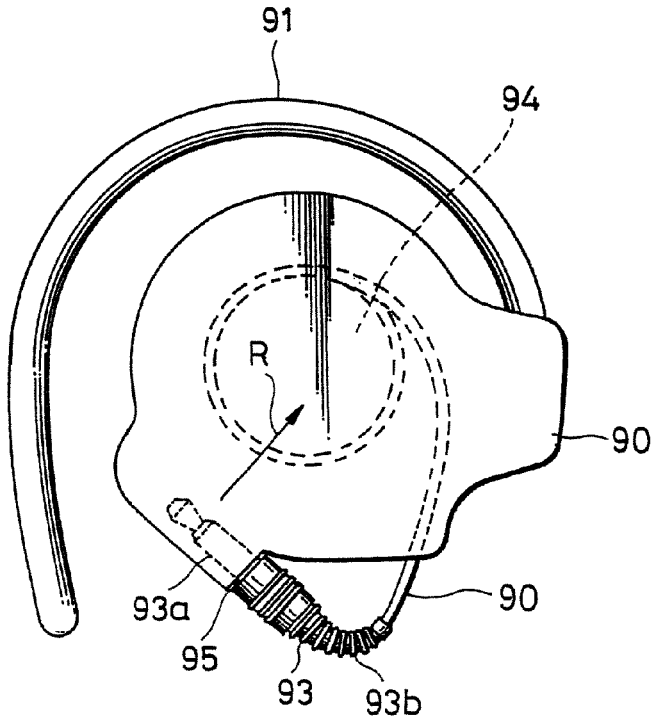
FIG. 12 PRIOR ART
FIG. 12 is an explanatory view showing an example of headphones provided with a conventional cord-winding mechanism.

FIG. 10 is an external view showing another example in which the cord winding means of the embodiment of the present invention is applied to headphones with a headband, and FIG. 11 is an external view showing an example of the state in which the headphones have been folded and a cord has been stored. In FIGS. 10 and 11, portions having the same structure as those in FIGS. 8 and 9 are given the same numerals and explanations thereof can be omitted. In FIG. 10, fixing ribs 28L and 28R are provided on the left and right respectively, on the inner diameter side of a bent portion of a headband 26 which connects left and right housings 21L and 21R, in other words, on the side of the headband 26 that comes in contact with his/her head when a user wearing headphones. When a plug-attached cord 24 is retracted and wound into the housing 21L: in the above-mentioned embodiments, left and right housings are joined to each other to release the locking; however, in this embodiment, the left housing 21L is folded-upward by means of a joining member 27L, and then a fixing rib 22L provided on the surface opposite to the surface in contact with the auricle to which sound from a loudspeaker unit inside the housing 21L is output, and the fixing rib 28L provided on the headband 26 are joined together, whereby pushing a release lever 23 provided in a concave portion of the rib 22L into the housing 21L to release the locking. When the locking is released, the cord 24 to which a plug 25 is connected is retracted and wound into the housing 21L. It should be noted that: since a fixing rib 22R provided on the right housing 21R and the fixing rib 28R provided on the headband 26 can be joined together in a similar manner, the left and right housings can be folded into the same shape, which is suitable to be stored and carried. In addition, with respect to headphones having a headband, also the shape, positions and material of fixing ribs are not particularly limited to the above embodiments.

INDUSTRIAL APPLICABILITY

According to the present invention, since a cord is retracted and wound by joining casings of left and right housings constituting headphones together, the cord can be retracted and wound favorably without applying unnecessary force thereto.

Further, according to the present invention, since the locking is released by combining the left and right casings independently provided into one, a cord can not be retracted and wound with headphones being worn on a user's auricles, and a plug at the end of the cord can therefore be prevented from hitting an auricle or the face when being pulled in with great force.

Furthermore, according to the present invention, the left and right casings are combined into one, so that storage property and portability can be improved.

The invention claimed is:

1. Headphones comprising:

first and second housings each of which incorporates a loudspeaker unit, having ribs capable of joining each other;

a plug-attached cord, one end of which is connected to the inside of said first housing, and the other end of which is provided with a plug;

inside said first housing, plug-attached cord winding means to retract and wind said cord by means of the resilience of a spring and locking means to control the retracting and winding by said plug-attached cord winding means; and release means to release the control over the retracting and winding of the plug-attached cord by said locking means, when the second housing is joined to the first housing by means of said ribs.

2. Headphones according to claim 1, further comprising:

a connecting cord which connects said first and second housings;

inside said first or second housing, connecting cord winding means to retract and wind said connecting cord by means of the resilience of a spring and locking means to control the retracting and winding by said connecting cord winding means; and release means to release the control over the retracting and winding of the connecting cord by said locking means, when the second housing is joined to the first housing by means of said ribs.

3. Headphones according to claim 2, wherein said first and second housings have hangers to be worn on the auricles.

4. Headphones according to claim 1, further comprising:

a headband connecting said first and second housings, wherein said first and second housings, which are connected using said headband, can be combined by said ribs.

* * * * *